US011448479B1

(12) United States Patent
Liu

(10) Patent No.: US 11,448,479 B1
(45) Date of Patent: Sep. 20, 2022

(54) PROTECTION DEVICE FOR LIMBS OF CROSSBOW

(71) Applicant: Chi-Chang Liu, Taichung (TW)

(72) Inventor: Chi-Chang Liu, Taichung (TW)

(73) Assignee: POE LANG ENTERPRISE CO., LTD., Taichung (TW)

( * ) Notice: Subject to any disclaimer, the term of this patent is extended or adjusted under 35 U.S.C. 154(b) by 0 days.

(21) Appl. No.: 17/379,944

(22) Filed: Jul. 19, 2021

(51) Int. Cl.
*F41B 5/12* (2006.01)
*F41B 5/14* (2006.01)
*F41B 5/10* (2006.01)

(52) U.S. Cl.
CPC ..... *F41B 5/1426* (2013.01); *F41B 5/123* (2013.01); *F41B 5/10* (2013.01)

(58) Field of Classification Search
CPC ..... F41B 5/12; F41B 5/123; F41B 5/1426
See application file for complete search history.

(56) References Cited

U.S. PATENT DOCUMENTS 4,671,249 A * 6/1987 Troncoso ..... F41B 5/0057 124/23.1
5,427,085 A * 6/1995 Martin ..... F41B 5/1496 124/1
5,630,405 A * 5/1997 Nizov ..... F41B 5/123 124/25
11,255,629 B2 * 2/2022 D'Acquisto ..... F41B 5/1426
2009/0014239 A1 * 1/2009 Mancini ..... F41B 5/1426 182/187

* cited by examiner

*Primary Examiner* — John A Ricci

(57) ABSTRACT

A protection device of a crossbow includes a protection coat that is mounted to the limb. The flexibility of the protection coat greater than the flexibility of the limb so that the protection coat is deformed with the limb when the limb is deformed. The protection coat absorbs vibration from the limb when the limb bounces back so as to protect the limb from being broken by reducing the vibration amplitude.

2 Claims, 5 Drawing Sheets

PROTECTION DEVICE FOR LIMBS OF CROSSBOW

BACKGROUND OF THE INVENTION

1. Fields of the Invention

The present invention relates to a protection device for limbs of a crossbow.

2. DESCRIPTIONS OF RELATED ART

The limbs of a crossbow are usually made of glass fiber, carbon fiber or wood. The fiber is arranged to produce elastic force for archery when it is bent. Among them, glass fiber has the advantages of lightness, corrosion resistance, aging resistance, waterproof and moisture-proof and insulation, so it is often used in the manufacture of various sports equipment. Carbon fiber has the advantages of high strength, light weight, high chemical resistance, and high temperature resistance. It is also a popular material for sports equipment.

However, glass fiber and carbon fiber each have a certain service life, and will weaken the strength along with time. As shown in FIGS. 5 and 6, the glass fiber made limbs 30 each have a connection end 31 for being connected with the riser 40, and a hole 32 is provided away from the riser 40 and is connected with a cam 33. A string 41 is connected between the two respective cams 33 on the two limbs 30. The limbs 30 are deformed to store energy, and when the string 41 is released, the limbs 30 bounce back to shoot the arrow. It is noted that the limbs 30 flexibly swings up and down as shown in FIG. 5 by dotted lines.

Not only noise is generated during the swinging action of the limbs 30, the fiber of the limbs 30 may be broken and cracks 34 are formed which can reduce the life of the limbs 30.

The present invention intends to provide a protection device for limbs of a crossbow to eliminate shortcomings mentioned above.

SUMMARY OF THE INVENTION

The present invention relates to a protection device of a crossbow and includes a protection coat mounted to the limb, and the flexibility of the protection coat greater than the flexibility of the limb. The protection coat is deformed with the limb when the limb is deformed. The protection coat absorbs vibration from the limb when the limb bounces back so as to protect the limb from being broken by reducing the vibration amplitude.

The primary object of the present invention is to provide a protection device that protects the limb of a crossbow from being broken by reducing the vibration amplitude of the limb.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
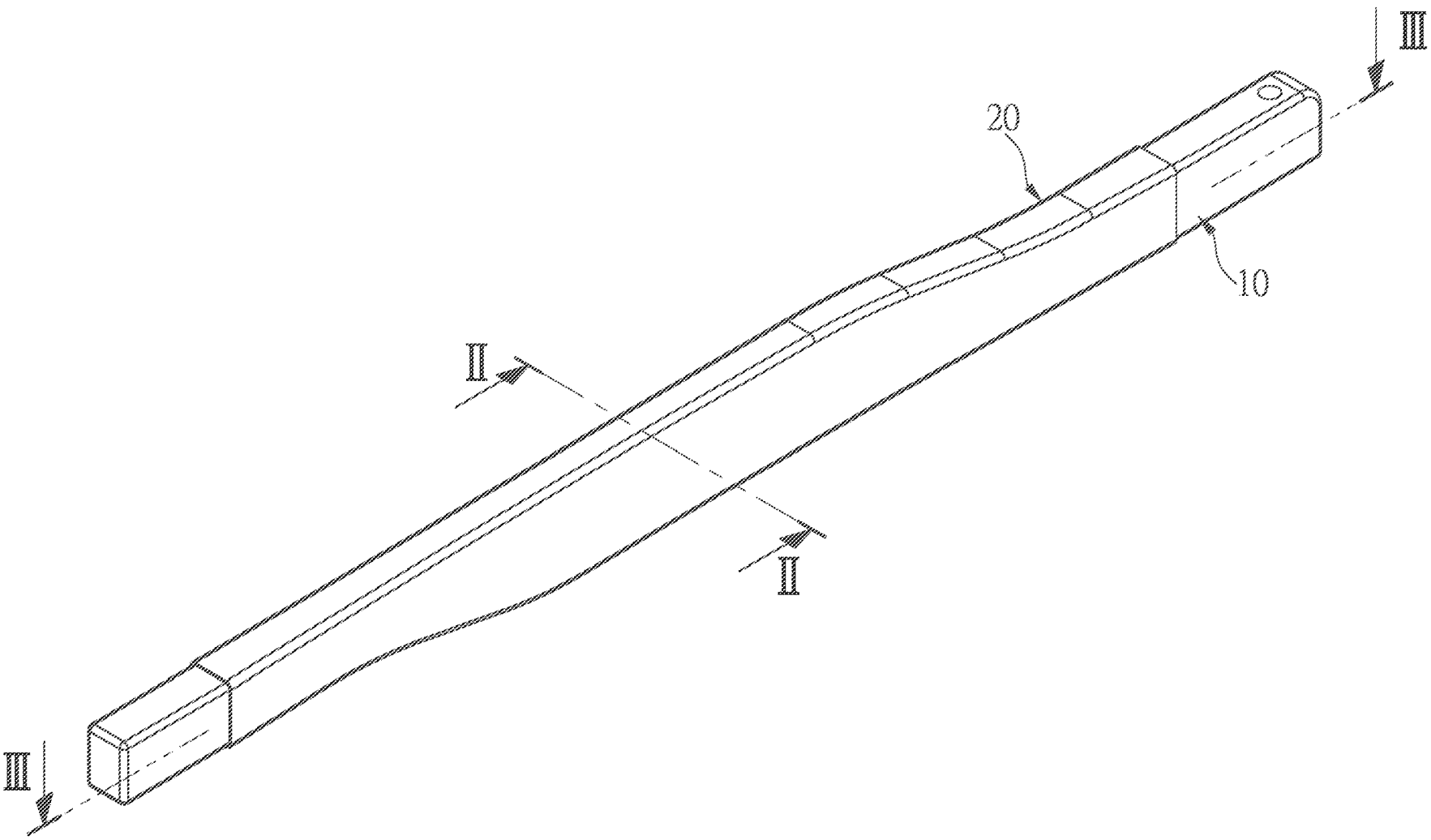
FIG. 1 is a perspective view to show a crossbow limb with the protection coat of the present invention connected thereto.
Figure 2:
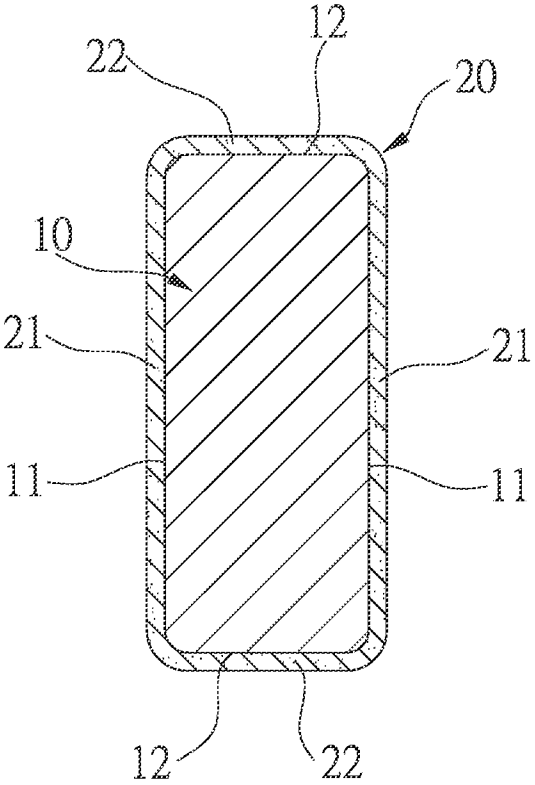
FIG. 2 is a cross sectional view, taken along line II-II in FIG. 1.
Figure 3:
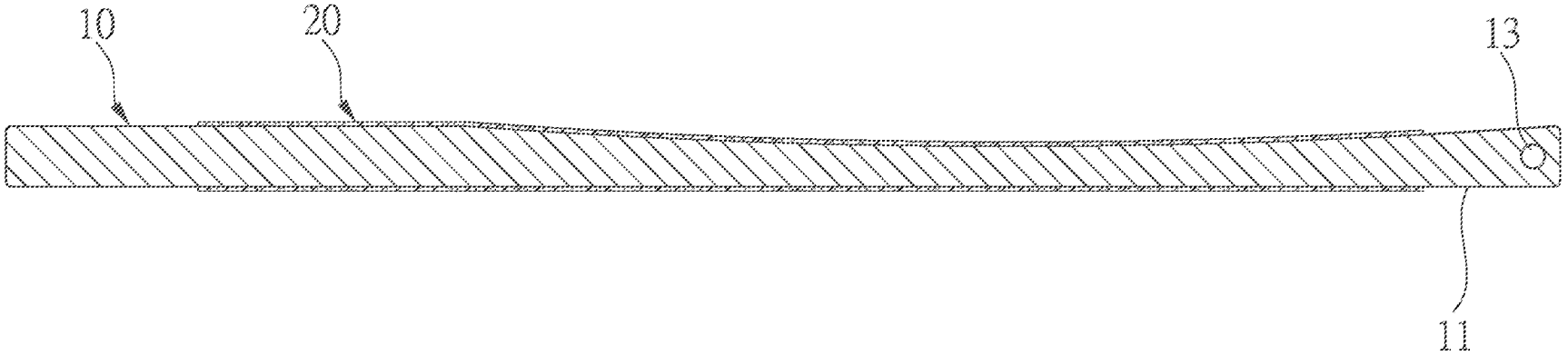
FIG. 3 is a cross sectional view, taken along line III-III in FIG. 3.
Figure 4:
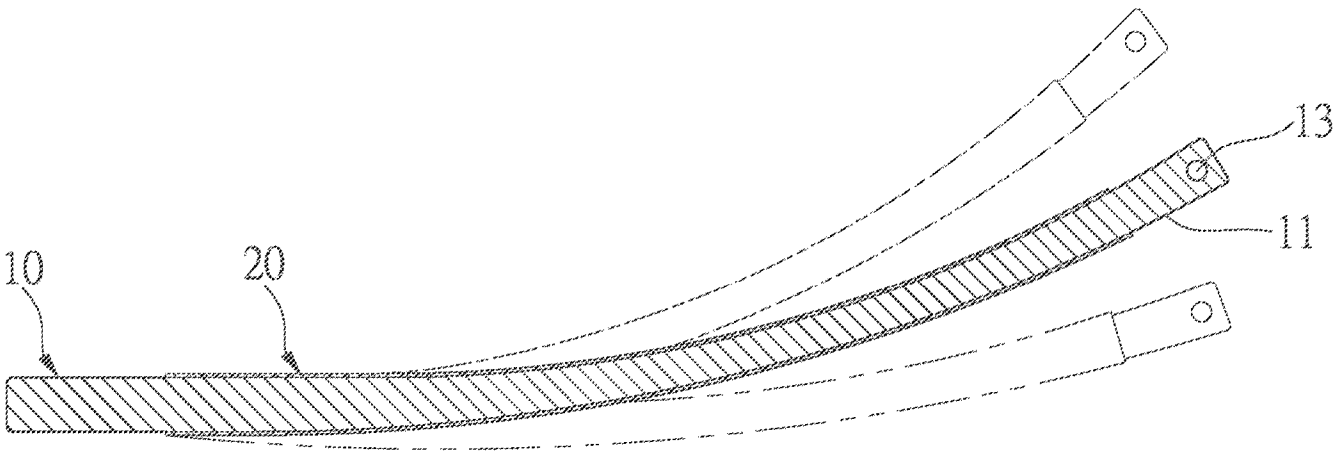
FIG. 4 is a cross sectional view to show that the protection coat of the present invention is deformed with the crossbow limb.

Referring to FIGS. 1 to 4, the protection device of the present invention comprises a protection coat 20 that is mounted to a limb 10 of a crossbow (not shown). The flexibility of the protection coat 20 is greater than the flexibility of the limb 10. The protection coat 20 is deformed with the limb 10 when the limb 30 is deformed, so that the protection coat 20 absorbs vibration from the limb 10 and reduces the vibration amplitude of the limb 10 when the limb 10 bounces back so as to protect the limb 30 from being broken. The protection coat 20 is connected to four sides of the limb 10 to protect sufficient protection feature. In this embodiment, two ends of the limb 10 can he exposed as shown in FIGS. 1, 3 and 4.

Figure 5:
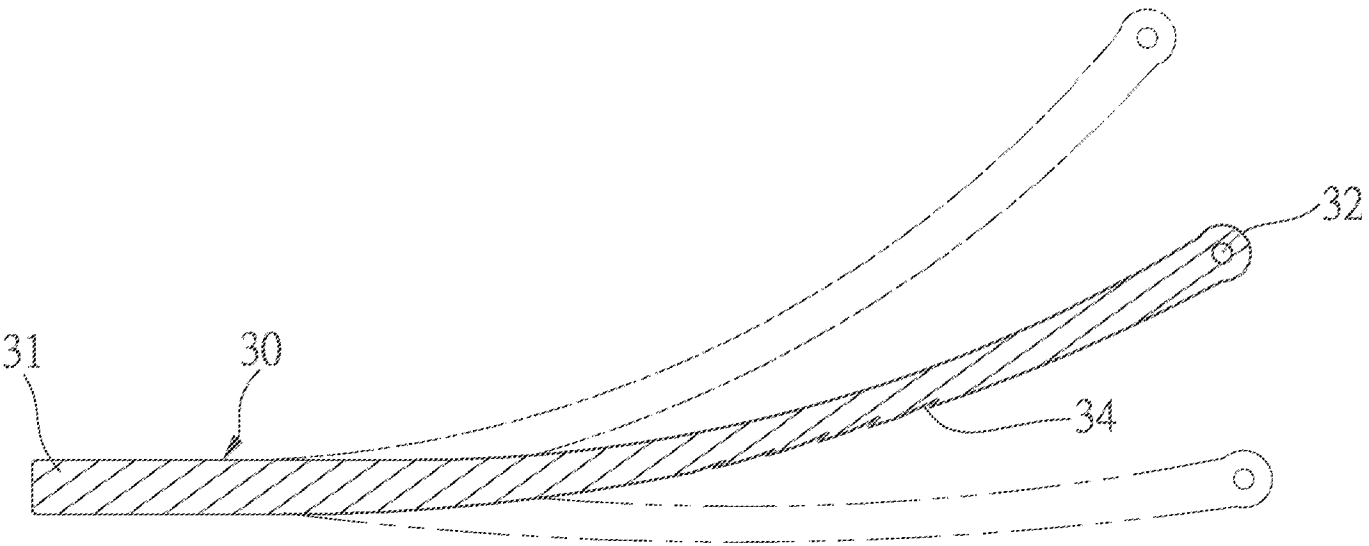
FIG. 5 is a cross sectional view to show that a conventional crossbow limb is deformed.

As shown in FIG. 4, one end of the limb 10 is connected with a cam, and when the limb 10 is deformed and bend, the protection coat 20 is deformed and bent with the limb 10, because the flexibility of the protection coat 20 is greater than the flexibility of the limb 10, so that when the arrow is released, the protection coat 20 absorbs vibration from the limb 10 and reduces the vibration amplitude of the limb 10 as illustrated by the dotted lines. It is noted that the vibration amplitude of the limb 10 is smaller than that of the conventional limb 30 as shown in FIG. 5. Therefore, the inner structure of the limb 10 is not broken and the life of the limb 10 is prolonged. Besides, the noise of the limb 10 can be reduced due to the reduced vibration amplitude. The flexibility of the protection coat 20 is greater than the flexibility of the limb 10, so that the energy of the limb 10 can be maintained.

Specifically, the limb 10 has a substantially rectangular cross section, and includes two first faces 11 and two second face 12. The two first faces 11 are located opposite from each other and extend in the axial direction of the limb 10. The second faces 12 are located opposite from each other and formed between the two first faces 11. The width of each first face 11 is greater than the width of each second face 12 as shown in FIG. 2. A hole 13 is defined through on end of the limb 10 and through the two second faces 12. The cam is connected to the hole 13. When the limb 10 is deformed, the first faces 11 with larger widths share the force for deforming the limb 10 to reduce the deformation of the limb 10.

In addition, the protection coat 20 includes two first parts 21 and two second parts 22, wherein the two first parts 21 are connected to outside of the first faces 11 of the limb 10, and the two second parts 22 are connected to outside of the second faces 11 of the limb 10.

The protection coat 20 includes thermoplastic elastomers, thermoset elastomers, or a mixture of the thermoplastic elastomers and the thermoset elastomers. The thermoplastic elastomers may be one of Thermoplastic Polyurethanes, (TPU), Thermoplastic Vulcanizate (TPV), Thermoplastic Olefin (TPO), Thermoplastic Rubber (TPS/TPR), Thermoplastic polyether Ester Elastomer (TPEE) and Terephthalic acid (PTA). The thermoset elastomers may include natural rubber and silicone.

The protection coat 20 is connected to outside of the limb 10 by way of injection molding. Alternatively, the protection coat 20 is connected to outside of the limb 10 by way of hot press molding.

The advantages of the present invention are that the vibration amplitude of the limb 10 is reduced because the vibration is absorbed by the protection coat 20 so that the inner structure of the limb 10 is not broken and the life of the limb 10 is prolonged.

The noise when operating the limb 10 is reduced to enhance the quality of use of the limb 10.

Figure 6:
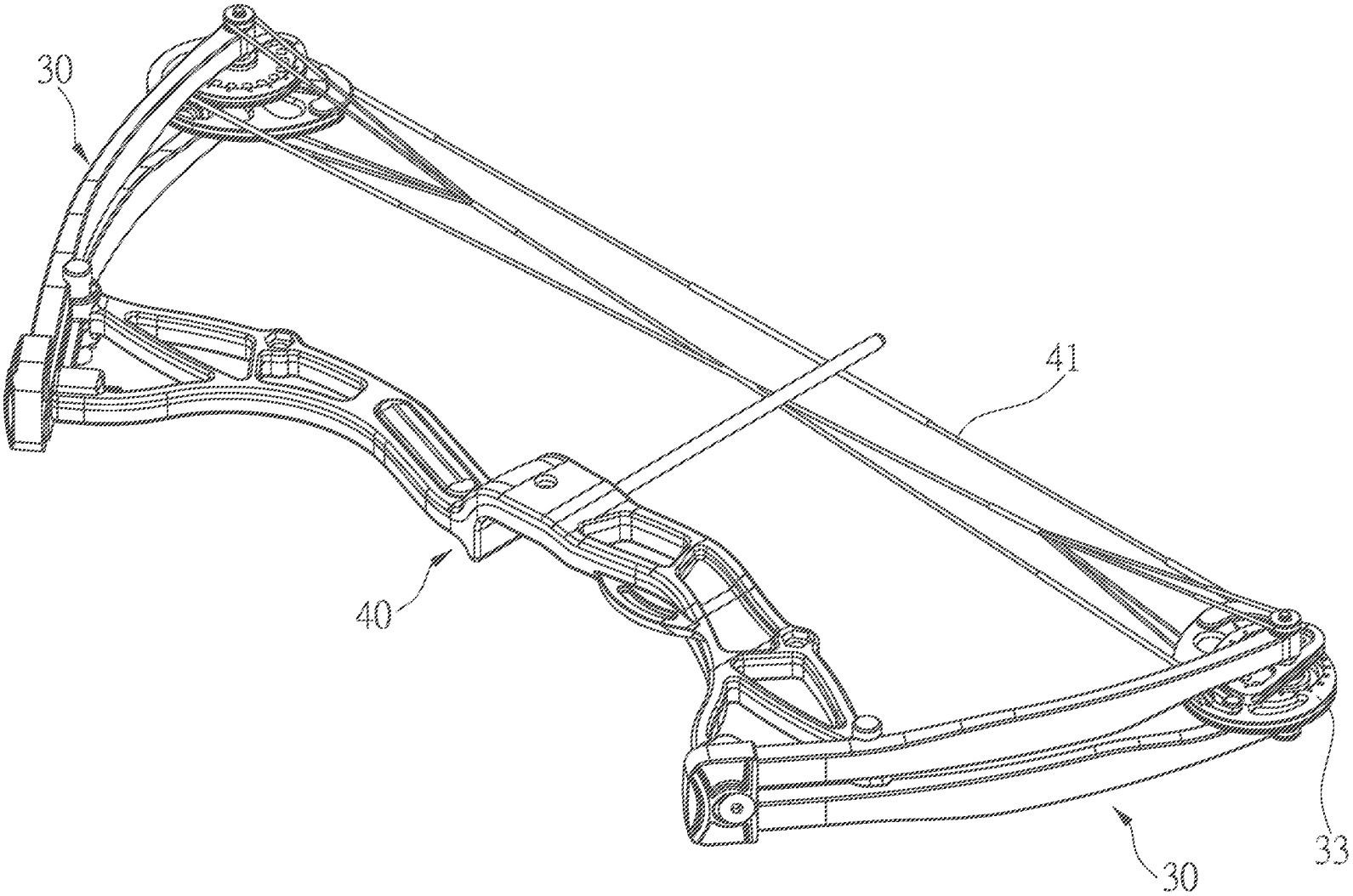
FIG. 6 shows a conventional crossbow with two limbs as shown in FIG. 5.

Referring to FIGS. 4 to 6, the flexibility of the protection coat 20 is greater than the flexibility of the limb 10 so that the protection coat 20 is deformed with the limb 10, and the protection coat 10 assists the limb 10 to store energy.

While we have shown and described the embodiment in accordance with the present invention, it should be clear to those skilled in the art that further embodiments may be made without departing from the scope of the present invention.

What is claimed is:

1. A protection device of a crossbow, comprising:

a limb, the limb including two first faces and two second faces, the two first faces located opposite from each other and extending in an axial direction of the limb, the second faces located opposite from each other and formed between the two first faces, a width of each first face being greater than a width of each second face, a hole defined through one end of the limb and through the two second faces, and a protection coat mounted to the limb, the protection coat including two first parts and two second parts, the two first parts connected to outside of the first faces of the limb, the two second parts connected to outside of the second faces of the limb, a flexibility of the protection coat being greater than a flexibility of the limb, the protection coat being deformed with the limb when the limb is deformed, two ends of the limb being exposed and not being mounted by the protection coat, the protection coat absorbing vibration from the limb when the limb bounces back so as to protect the limb from being broken.

2. The protection device of a crossbow as claimed in claim 1, wherein the protection coat includes thermoplastic elastomers and thermoset elastomers.

* * * * *